US008424127B2

(12) United States Patent
An

(10) Patent No.: US 8,424,127 B2
(45) Date of Patent: Apr. 23, 2013

(54) MASSAGE APPARATUS WITH MUSIC PLAYER FOR USE IN THE BATHROOM

(76) Inventor: Seung Geun An, Changwon-si (KR)

( * ) Notice: Subject to any disclaimer, the term of this patent is extended or adjusted under 35 U.S.C. 154(b) by 315 days.

(21) Appl. No.: 12/999,101

(22) PCT Filed: Dec. 11, 2009

(86) PCT No.: PCT/KR2009/007432

§ 371 (c)(1),
(2), (4) Date: Dec. 15, 2010

(87) PCT Pub. No.: WO2010/071331

PCT Pub. Date: Jun. 24, 2010

(65) Prior Publication Data

US 2011/0119824 A1 May 26, 2011

(30) Foreign Application Priority Data

Dec. 16, 2008 (KR) ..... 10-2008-0127596

(51) Int. Cl.
*A47K 3/00* (2006.01)

(52) U.S. Cl.
USPC ..... 4/541.1; 4/559

(58) Field of Classification Search ..... 4/541.1–541.5, 4/559

See application file for complete search history.

(56) References Cited

FOREIGN PATENT DOCUMENTS

| | | |
|---|---|---|
| JP | 04-089015 | 3/1992 |
| JP | 07-031652 | 2/1995 |
| JP | 2005-110783 | 4/2005 |
| KR | 10-2003-0040979 | 5/2003 |
| KR | 10-0679731 | 2/2007 |

OTHER PUBLICATIONS

International Search Report for PCT/KR2009/007432 Mailed on Aug. 2, 2010.

*Primary Examiner* — Huyen Le
(74) *Attorney, Agent, or Firm* — Christopher Paul Mitchell

(57) ABSTRACT

The present invention relates to a massage apparatus with a music player for use in the bathroom. More particularly, the present invention relates to a massage apparatus for use in the bathroom which is equipped with a massager that sprays water through a plurality of nozzles to provide a massage effect, said massage apparatus comprising: a bathtub with the massager installed in the lower portion thereof, having a bottom surface tilted upwards; a transfer pipe, one end of which is arranged vertically to the bottom surface of the bathtub and the other end of which is bent toward the ears of a user; a music box having an interior into which the transfer pipe is inserted, and in which a music player is embedded, and a lower portion with an outlet hole; and a drain pipe, one end of which communicates with the outlet hole and the other end of which is connected to a drain. The massage apparatus prevents the music player installed in the bathtub from contacting water, thereby preventing the failure or erroneous operation of the music player, and improves the quality of life of a user by enabling the user to enjoy massages while listening to music.

8 Claims, 3 Drawing Sheets

MASSAGE APPARATUS WITH MUSIC PLAYER FOR USE IN THE BATHROOM

RELATED APPLICATIONS

This application is a 371 application of International Application No. PCT/KR2009/007432, filed Dec. 11, 2009, which in turn claims priority from Korean Patent Application No. 10-2008-0127596, filed Dec. 16, 2008, each of which is incorporated herein by reference in its entirety.

TECHNICAL FIELD

The present invention relates to a massage apparatus with a music player for use in the bathroom, particularly a massage apparatus with a music player for use in the bathroom which is equipped with a music player and a transfer pipe such that music can be heard, without contacting with water in the bathtub, thereby allowing a user for recovering from fatigue while listening to music.

BACKGROUND ART

In general, taking a bath makes secretion of hormones smooth by promoting metabolism, relieves stress and fatigue, keeps the skin healthy and elastic, increases body temperature and makes perspiration such that body wastes are discharged with sweat and the skin can keep optimum moisture. Therefore, the bath significantly contributes to mental stabilization by relaxing a stiff body with relaxation of muscles, in addition to making the skin moist.

However, users can only have a common bath in public bathes, because there is lack of facilities, such that the most users cannot sufficiently relieve their bodily fatigue and other fatigue.

On the other hand, although some places have nozzles for water massage on the cell, the massaged parts are limited, water splashes out of the bathtub and causes others inconvenience, and the effect of the water massage is not more than the expectable level.

Accordingly, devices for massaging the entire body of a user from the lower portion of a bathtub have been disclosed in Korean Patent Registration Nos. 10-2004-0025147 and 10-2006-0046215 and Korean Utility Model Registration No. 20-2004-0015368, in order to overcome the problems described above.

However, modern people live, considering the mental health as well as the physical health. Therefore, they have a massage with a massager disposed in a bathtub while listening to music from speakers and music players installed not to contact with water in the public bathes or home. However, it is difficult to listen to music and the sound is mixed with noise around, because the speakers and music players are far way from each other, such that the devices degenerated into noise makers.

DISCLOSURE

Technical Problem

The present invention has been made in order to solve the problems and it is an object of the present invention to provide a massage apparatus with a music player for use in a bath which allows a user to have a massage while listening to soft music by installing a music player in a bathtub and also installing a transfer pipe to transfer music to the user while keeping the music player not contacting with water.

Technical Solution

In order to achieve the object of the present invention described above, a massage apparatus with a music player for use in the bathtub, which is equipped with massagers that spray water through a plurality of nozzles to provide a massacre effect, includes: a bathtub having the massagers embedded in the lower portion the bottom inclining to the upper portion from the lower portion; transfer pipes each of which have one part embedded in the bathtub, perpendicular to the ground, and the other part bending toward the user's ear; a music box where the transfer pipes are inserted and which accommodates a music player and has an outlet hole at the bottom; and a drain pipe having one end communicating with the outlet hole and the other end connected to a drain.

Further, the transfer pipe further has a connecting pope connecting the portion inserted in the music box with the music player.

Further, the connecting pipe is inclined such that the end connected with the music player is positioned at the upper portion.

Further, the massage apparatus with a music player for use in the bathtub further includes: solenoid valves disposed in the nozzles of the massagers; a sensor detecting the intensity of sound generated from the music player; and a controller generating control signals for controlling the solenoid valves on the bass of values inputted from the sensor.

Further, the bathtub has a music switch at one side, which allows selecting music generated from the music player.

Advantageous Effect

As described above, first, it is possible to prevent failure or erroneous operation of the music player, because water cannot contact with the music player installed in the bathtub.

Second, a user can have a massage while listening to music, such that the quality of life is improved.

REFERENCE NUMERALS

| | |
|---|---|
| 10: Bathtub | 12: Switch unit |
| 14: Massage switch | 16: Music switch |
| 20: Massager | 22: Nozzle |
| 24: Solenoid Valve | 30: Transfer pipe |

-continued

| | |
|---|---|
| 40: Music box | 42: Music player |
| 44: Connecting pipe | 46: Outlet hole |
| 50: Drain pipe | |

Best Mode

Hereinafter, an apparatus with a music player for use in a bath is described with reference to the accompanying drawings.

Figure 1:
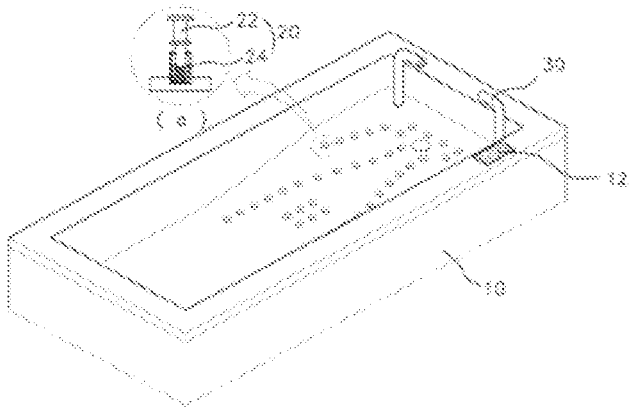
FIG. 1 is a perspective view showing a massage apparatus with a music player for use in a bath according to the present invention.

FIG. 1 is a perspective view showing a massage apparatus with a music player for use in a bath according to the present invention.

As shown in FIG. 1, the present invention includes: a bathtub 10 equipped with massagers 20, which spray water through a plurality of nozzles 22 for massage, embedded in the bottom inclining from the lower portion to the upper portion; transfer pipes 30 each of which has a part embedded perpendicular to the ground in the bathtub 10 and the other part bending to the users' ear; a music box 40 where the transfer pipes 30 embedded, and which accommodates a music player 42 and has an outlet hole 46 through the bottom; and a drain pipe 50 having one end communicating with the outlet hole 46 and the other end connected to a drain.

Hereinafter, each configuration is described in detail.

The bathtub 10 has a space for a user to take a bath therein and the bottom inclining toward the user's head to make the user convenient, and may be made of eco-friendly materials, such as marble, in various ways, depending on the user's taste.

Further, the massagers 20 that have the nozzles 22 and massage the user by spraying water through the nozzles 22 are disposed in the bottom of the bathtub 10. In this configuration, (a) the nozzle 22 in FIG. 1 is equipped with a solenoid valve 24 that is operated by electricity to open or close the nozzle 22, thereby spraying water.

Further, the bathtub 10 is equipped with a switch unit 12 at one side, which operates the massagers 20 and a music player 42, which is described, below.

Preferably, the massagers 20 are intensively concentrated around the meridian pathways to most efficiently relieve the user's fatigue.

Figure 2:
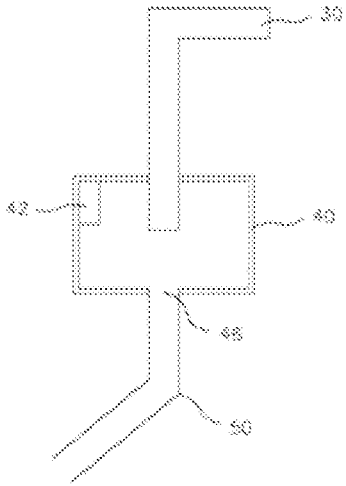
FIG. 2 is a diagram showing a coupled relationship of a transfer pipe, a music box, and a drain pipe according to the present invention.

FIG. 2 is a diagram showing coupled relationship of a transfer pipe, a music box, and a drain pipe according to the present invention.

As shown in the figure, the transfer pipes 30 according to the present invention are positioned in a pair at the upper portion of the bathtub 10, with one part embedded in the bathtub 10 and the other bending, respectively. In detail, the transfer pipe is made of a material having corrosion resistance against water a pipe shape, with the part embedded in the bathtub 10 perpendicular to the ground and the other part protruding outward from the bathtub bending toward the user's ear. Therefore, although some of water spayed through the massagers 20 splashes into the transfer pipes 30, the water cannot contact with the music player 42, which is describe below, by the music box 40 and the drain pipe 50, which is described in detail below.

The music box 40 according to the present invention is coupled to the transfer pipe 30 and has a space therein, such that it accommodates the music player 42 making music or good sound and has the outlet hole 46 at the bottom. In this configuration, a portion of an end of the transfer pipe 30 is inserted in the music box 40.

Further, is preferable that the music box 40 is made of a material having good resonance such that the sound made from the music player 42 spreads well.

Meanwhile, although the music box 40 can be embedded in the bathtub 10, the music box 40 may be generally positioned in a specific space, such as a boiler room, under the bathtub 10.

The drain pipe 50 according to the present invention has a pipe shape with one end communicating with the outlet hole 46 of the music box 40 and the other end connected to a drain discharging water. Therefore, the drain pipe 50 can be bent several times in accordance with the position of the drain.

Figure 3:
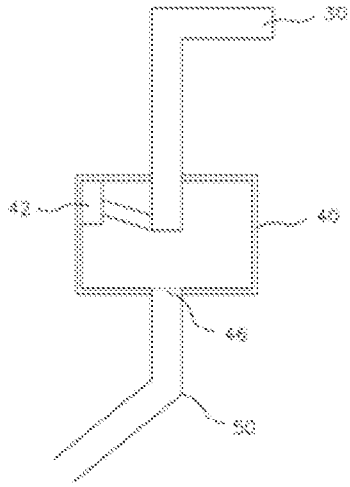
FIG. 3 is a diagram showing a preferred coupled relationship of a transfer pipe, a music box, and a drain pipe according to the present invention.

FIG. 3 is a diagram showing a preferred coupled relationship of a transfer pipe, a music box, and a drain pipe according to the present invention.

As described above, the transfer pipe 30 has one part embedded perpendicularly in the bathtub 10 and inserted in the music box 40 and the music box 40 accommodates the music player 42, has the outlet hole 56 at the bottom, and communicates with the drain pipe 50.

Preferably, as shown in FIG. 3, the transfer pipe 30 may further have a connecting pipe 44 that communicates with the side in the music box 40 to transfer the sound generated from the music player. That is for directly transferring the sound generated from the music player 42.

Further, it is preferable that the connecting pipe 44 is inclined, such that the end connected with the music player 42 is positioned at the upper portion. Accordingly, since the connecting pipe 44 communicating with the transfer pipe 30 is inclined, water cannot flow backward, because the water flows down from above.

Preferably, since the nozzle of the massagers 20 are opened/closed by the solenoid valves 24, the present invention further includes a controller (not shown) generating control signals for opening/closing the solenoid valves 24 and a sensors (not shown) detecting the magnitude of the sound generated from the music player 42 and transmitting it to the controller (not shown). In detail, the solenoid valve 24 is opened/closed by a rod operated by electricity, such that the control signal of the controller (not shown) is apparently an electric signal, and a control circuit opening/closing the solenoid valve 24 in response to the signal transmitted from the sensor (not shown) is included. Further, transmits a high magnitude signal to the controller (not shown), when high-pitched sound is generated, and transmits a low-magnitude signal to the controller (not shown), when low-pitched sound is generated, because the music player 42 generates various sounds.

Figure 4:
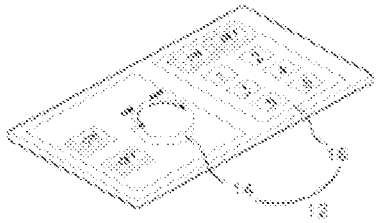
FIG. 4 is a perspective view showing a switch unit according to the present invention.

FIG. 4 is a perspective view showing a switch unit according to the present invention.

As shown in the figure, the switch unit 12 disposed on the bathtub 10 includes music switches 16 for selecting the music played by the music players 42, such that the user can listen a variety of music. Further, a massage switch 14 for adjusting intensity of the massagers 20 is provided. However, the massage switch 14 is provided with various functions, which is well known in the art and the detailed description is not provided.

Next, an embodiment of a massage apparatus with a music player for use in a bathtub according to the present invention is described.

Figure 5:
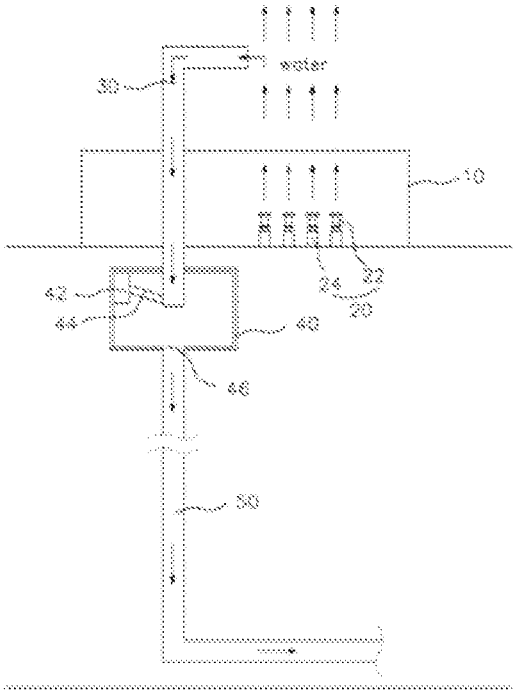
FIG. 5 is a view showing the operation of the apparatus with a music player for use in a bath according to the present invention.

FIG. 5 is a view showing an embodiment of a massage apparatus with a music player for use in a bathtub according to the present invention.

As shown in the figure, a user operates the massage switch 14 of the switch unit 12 and selects desired music using the music switch 16 while taking a bath in the bathtub 10.

Accordingly, the massagers 20 spay water to the user through the nozzles 22, in which the intensity of the water sprayed from the massagers 20 depends on the tone of the sound generated from the music player 42. That is, when the music player 42 plays music and the sensor (not shown) detects the tone of the music and transmits the intensity of the tone to the controller (not shown), the controller (not shown) adjusts the intensity of the massager 20 by sending a control signal to the solenoid valves 24.

Further, according to another method of spraying water from the massagers 20, when high-pitched sound is generated from the music player 42, the controller (not shown) controls the solenoid valves 24 such that water is sprayed through the nozzles 22 to massage from the feet to the shoulders of the user, whereas when low-pitch sound is generated, water is sprayed to massage the user's waist, hip, and legs, with the nozzles 22 around the shoulders closed. However, the controller (not shown) may be provided with various control circuits.

In particular, although water may splash in to the transfer pipe by the spraying of water or carelessness of the user during a massage, the water cannot contact with the music player 42, because the transfer pipes 30 embedded in the bathtub 10 is perpendicular to the ground and the connecting pipe 44 inclines.

Therefore, the water splashing in the transfer pipe 30 is discharged to the drain along the drain pipe 50 through the outlet hole 46 of the music box 40.

The spirit of the present invention described above is to install a music player in a bathtub equipped with massagers, without contacting with water and this is an example. Therefore, it should be understood that various modified and equivalent embodiments may be implemented by those skilled in the art and the protective scope of the present invention should be construed within claims.

INDUSTRIAL APPLICABILITY

The present invention can be used for a massage apparatus with a music player for use in a bathtub, that is, a massage apparatus with a music player for use in a bathtub which allows a user to relive physical fatigue while listening to soft music, by manufacturing a music player and transfer pipe allows the user to listen to music, without contacting with water, in a bathtub.

The invention claimed is:

1. A massage apparatus with a music player for use in the bathtub which is equipped with massagers that spray water through a plurality of nozzles to provide a massage effect, the massage apparatus comprising:

a bathtub having the massagers embedded in the lower portion the bottom inclining to the upper portion from the lower portion;

transfer pipes each of which have one part embedded in the bathtub, perpendicular to the ground, and the other part bending toward the user's ear;

a music box where the transfer pipes are inserted and which accommodates a music player and has an outlet hole at the bottom; and a drain pipe having one end communicating with the outlet hole and the other end connected to a drain.

2. The massage apparatus with a music player for use in the bathtub according to claim 1, wherein the transfer pipe further has a connecting pope connecting the portion inserted in the music box with the music player.

3. The massage apparatus with a music player for use in the bathtub according to claim 2, wherein the connecting pipe is inclined such that the end connected with the music player is positioned at the upper portion.

4. The massage apparatus with a music player for use in the bathtub according to claim 3, wherein the bathtub has a music switch at one side, which allows selecting music generated from the music player.

5. The massage apparatus with a music player for use in the bathtub according to claim 2, wherein the bathtub has a music switch at one side, which allows selecting music generated from the music player.

6. The massage apparatus with a music player for use in the bathtub according to claim 1, further comprising:

solenoid valves disposed in the nozzles of the massagers;

a sensor (not shown) detecting the intensity of sound generated from the music player; and a controller (not shown) generating control signals for controlling the solenoid valves on the basis of values inputted from the sensor (not shown).

7. The massage apparatus with a music player for use in the bathtub according to claim 6, wherein the bathtub has a music switch at one side, which allows selecting music generated from the music player.

8. The massage apparatus with a music player for use in the bathtub according to claim 1, wherein the bathtub has a music switch at one side, which allows selecting music generated from the music player.

* * * * *